US007782171B2

(12) United States Patent
Habboosh

(10) Patent No.: US 7,782,171 B2
(45) **Date of Patent: *Aug. 24, 2010**

(54) EXTENDED TEMPERATURE RANGE HEATER

(75) Inventor: Samir W. Habboosh, Hamden, CT (US)

(73) Assignee: Harco Laboratories, Inc., Branford, CT (US)

( * ) Notice: Subject to any disclaimer, the term of this patent is extended or adjusted under 35 U.S.C. 154(b) by 1074 days.

This patent is subject to a terminal disclaimer.

(21) Appl. No.: 11/360,788

(22) Filed: Feb. 23, 2006

(65) Prior Publication Data

US 2006/0139142 A1 Jun. 29, 2006

Related U.S. Application Data

(63) Continuation-in-part of application No. 10/793,120, filed on Mar. 4, 2004, now Pat. No. 7,061,364, which is a continuation-in-part of application No. 10/712,484, filed on Nov. 13, 2003, now Pat. No. 7,026,908.

(51) Int. Cl.
*H01C 3/04* (2006.01)

(52) U.S. Cl. ..... 338/28; 338/22 R

(58) Field of Classification Search ..... 338/28, 338/22 R

See application file for complete search history.

(56) References Cited

U.S. PATENT DOCUMENTS 3,408,311 A 10/1968 Short
3,513,432 A 5/1970 Davis
3,573,229 A 3/1971 Herbst
3,622,310 A 11/1971 Reinacher et al.
3,696,502 A 10/1972 Darling
3,709,667 A 1/1973 Selman et al.
3,890,456 A 6/1975 Dils
4,002,503 A 1/1977 Bourne et al.
4,018,599 A 4/1977 Hill et al.
4,045,247 A 8/1977 Morris
4,111,718 A 9/1978 Morris
4,906,965 A 3/1990 Murata et al.
4,906,968 A 3/1990 Gershenfeld et al.
5,610,572 A * 3/1997 Yajima ..... 338/22 R
5,844,122 A * 12/1998 Kato ..... 73/1.06
5,889,460 A 3/1999 Bachmann et al.

(Continued)

FOREIGN PATENT DOCUMENTS

DE 4117828 9/1992

(Continued)

OTHER PUBLICATIONS

Above JP 57127837 abstract is provided.*

(Continued)

*Primary Examiner*—Kyung Lee
(74) *Attorney, Agent, or Firm*—St. Onge Steward Johnston & Reens LLC

(57) ABSTRACT

An electric resistive heater having an extended temperature range and repeatable heating characteristics. The resistor being formed of a material having at least one noble metal and an oxide selected from the group consisting of yttrium oxide, cerium oxide, zirconium oxide, and combinations of these. The resistor may further have the oxide dispersion hardened within grain boundaries and a main body portion of the noble metal.

22 Claims, 4 Drawing Sheets

U.S. PATENT DOCUMENTS

| | | | | |
|---|---|---|---|---|
| 5,999,081 | A | 12/1999 | Hannigan et al. | |
| 6,081,182 | A | 6/2000 | Tomozawa et al. | |
| 6,151,771 | A | 11/2000 | Tzeng et al. | |
| 6,239,351 | B1 | 5/2001 | Hall, Jr. | |
| 6,272,735 | B1 | 8/2001 | Moriwake et al. | |
| 6,341,892 | B1 | 1/2002 | Schmermund | |
| 6,354,736 | B1 | 3/2002 | Cole et al. | |
| 6,936,148 | B2 * | 8/2005 | Mabuchi et al. | 204/425 |
| 7,061,364 | B2 * | 6/2006 | Habboosh | 338/28 |
| 2002/0084884 | A1 | 7/2002 | Takahashi et al. | |
| 2002/0131477 | A1 | 9/2002 | Kurano | |
| 2002/0190577 | A1 | 12/2002 | Jenni | |
| 2003/0136676 | A1 * | 7/2003 | Miwa et al. | 204/426 |

FOREIGN PATENT DOCUMENTS

| | | | |
|---|---|---|---|
| DE | 4330447 | | 3/1995 |
| JP | 57127837 | * | 8/1982 |
| JP | 03262101 | | 11/1991 |
| JP | 6-139836 | | 5/1994 |
| WO | WO 02/080620 A1 | | 10/2002 |

OTHER PUBLICATIONS

JM Noble Metals, ZGS Platinum Materials.

Pages from Engelhard-Clal web site; ODS, Oxide Dispersion Strengthened Platinum-Based Materials; Copyright 2000-2001.

European Search Report, Jul. 11, 2005, 2 pages.

* cited by examiner

EXTENDED TEMPERATURE RANGE HEATER

CROSS-REFERENCE

This application is a continuation in part of U.S. patent application Ser. No. 10/793,120 filed Mar. 4, 2004, now U.S. Pat. No. 7,061,364 which is a continuation in part of U.S. patent application Ser. No. 10/712,484 filed Nov. 13, 2003 now U.S. Pat. No. 7,026,908.

FIELD OF THE INVENTION

The present invention relates to a heating device that may be used at elevated temperatures, and more specifically to the construction of an electric heater made from a material that provides for precise temperature control with applied electrical power and will not degrade even at extreme temperatures.

BACKGROUND OF THE INVENTION

Conventional heaters, such as are utilized in aircraft sensors, or even for laboratory testing, use a variety of materials to produce heating elements having relatively high operating temperatures. However, these materials suffer from the detrimental effects of contamination, ionic migration, sublimation, oxidation and substantial decrease in mechanical strength with increased operating temperatures. Current electrical heating elements are thus limited to an operating envelope in the range of less than 650° C. (1200° F.) to ensure long term, stable output. Higher temperature heating devices may operate to temperatures up to 850° C. (1562° F.), but are either limited to specific environmental conditions (such as for instance: a vacuum environment, an inert gas environment, or a hydrogen atmosphere) and/or must be limited to short term operation to prevent premature failure. This temperature operating range has limited the application of these heating devices in for example, hostile, high temperature applications such as those commonly encountered in the aerospace, petroleum, glass industries, and laboratory testing applications.

Resistive electrical heating devices are useful for providing ambient heating. They are inexpensive and relatively simple to operate, where upon connection to a power source; the electrical resistance heating device will produce a repeatable heat output proportional to the applied electrical power. This provides a simple and inexpensive heating system. However, prior art electrical resistance type heaters have suffered from the problem of being limited to a fairly low melting temperature and, accordingly, have not been useable to provide substantial heating, such as in systems requiring heating up to 1500° C. (2730° F.). Not only have external thermal fields been a problem, resistive electric heaters have also typically, been unusable in environments where they are exposed to mechanical stress. In addition, electrical resistive heaters also suffer from the detrimental effects associated with the transmission of relatively high current levels.

Platinum is known to have a relatively high melting point and as such, may be desirable for use as a heating element. Platinum provides a number of advantages, such as being chemically stable and having highly repeatable heat output with applied electrical power. Other high melting, noble metals such as rhodium (Rh), palladium (Pd), iridium (Ir) as well as precious metals such as gold (Au) and silver (Ag), and alloys thereof are known. However, it should be noted that these materials do not offer the mix of strength, oxidation resistance, rupture strength at elevated temperature, resistivity, alpha, or oxide stability as Pt and Pt/Rh based materials.

This can be critical in highly sensitive experimentations, such as is required in laboratory experimentation.

Some of the characteristics of platinum can be improved by the alloy hardening method of adding a metal to the platinum base, followed by a heat treatment. However, problems can occur after alloying. For example, when a high concentration of any alloying element is added to the platinum base, the electrical properties of the resulting platinum limb become inferior; at the same time the hardening phase will partially or totally dissolve into the base at high temperatures, thus the effects of the hardening action are disadvantageously reduced.

Dispersing oxides of transition metals or rare earth metals within noble or precious metals is an example of a method of creating a resistance material with the desired extended temperature properties. For instance, dispersion hardened platinum materials (Pt DPH, Pt-10% Rh DPH, Pt-5% Au DPH) are useful materials because they achieve very high stress rupture strengths and thus permit greatly increased application temperatures than the comparable conventional alloys and are rugged.

Dispersion hardening (DPH) creates a new class of metal materials having resistance to thermal stress and corrosion resistance that is even greater than that of pure platinum and the solid solution hardened platinum alloys. When operational life, high temperature resistance, corrosion resistance and form stability are important, a heater may be manufactured of DPH platinum and can be used at temperatures close to the melting point of platinum.

Dispersion hardened materials contain finely distributed transition element oxide particles which suppress grain growth and recrystallization even at the highest temperatures and also hinder both the movement of dislocations and sliding at the grain boundaries. The improved high temperature strength and the associated fine grain stability offer considerable advantages. The article, "Platinum: Platinum-Rhodium Thermocouple Wire: Improved Thermal Stability on Yttrium Addition Platinum" By Baoyuan Wu and Ge Liu, Platinum Metals Rev., 1997, 41, (2), 81-85 ("the Wu article") is incorporated by reference. The Wu article discloses a process of dispersion hardening platinum for a platinum; platinum-rhodium thermocouple wire which incorporates traces of yttrium in the platinum limb.

As described in the Wu article, the addition of traces of yttrium to platinum as a dispersion phase markedly increases the tensile strength of the platinum at high temperature, prolongs the services life and improves the thermal stability. Yttrium addition prevents the growth in the grain size and helps retain the stable fine grain structure, as the dispersed particles of high melting point resist movements of dislocations thereby maintaining rupture strength at elevated temperature without a loss of ductility.

In order to harden metals, the movement of the dislocations needs to be restricted either by the production of internal stress or by putting particles in the path of the dislocation. After the melting and processing, the majority of the trace yttrium (in the dispersion phase of the platinum) becomes yttrium oxide, which has a much higher melting point than platinum. When the temperature is near the melting point, dispersion hardened particles fix the dislocation, thus hardening the platinum and increasing its strength.

At the same time the grain structure becomes stable after dispersion hardening and there is also microstructural hardening. The dispersed particles affect the recrystallization dynamics, inhibit rearrangement of the dislocations on the grain boundaries and prevent the movement of the grain boundaries. Therefore, this dispersion hardened platinum possesses a stable fine grain structure at high temperature.

This patent outlines an electrical resistance heating element that is capable of operating in the range of 1700° C. (3092° F.).

Accordingly, it is an object of the present invention to provide an electric heater exhibiting high mechanical hardness for protection of the heating element and/or conductors connected thereto.

Accordingly, it is another object of the present invention to provide an extended temperature range electrical resistance heater with enhanced high temperature operating characteristics and long term, stable output and minimum drift.

Yet another object of the present invention is to provide a method for the production of a cost effective, high reliability, stable resistance heater with an operating range of up to 1700° C. (3092° F.) in hostile environments.

SUMMARY OF THE INVENTION

These and other objects of the present invention are achieved in one advantageous embodiment by a heater comprising a resistor providing variable heating based upon the applied electrical power. The resistor being formed of a material having at least one noble metal and an oxide selected from the group consisting of yttrium oxide, cerium oxide, zirconium oxide, and combinations of these. A first conductor, formed from a first conductor material, is electrically connected to the resistor. A second conductor, formed from a second conductor material, is also electrically connected to the resistor.

It is contemplated that the resistor may, effectively be positioned on or about a substrate, by either winding the resistor around an insulator or the substrate, or by depositing the resistor on the substrate.

The objects of the present invention are further achieved in another embodiment by providing a heater which is resistant to degradation at high temperature having a resistor formed from an oxide. The oxide may in one advantageous embodiment, comprise the transition element oxides and rare earth metal oxides, and combinations of these, where the oxide is dispersion hardened within the grain boundary and within the base material of at least one base metal. The base metal may in one advantageous embodiment, comprise the noble metals and the precious metals, and combination of these, and is disposed on, for example, a substrate. The heater having at least a first and second lead connected to the resistor for transmitting electrical power.

In one advantageous embodiment, an electric heater is provided comprising, a resistor deposited on a substrate, the resistor giving off heat in proportion to applied electrical power. The resistor is formed of at least one noble metal and an oxide selected from the group consisting of yttrium oxide, cerium oxide, zirconium oxide, and combinations of these. The electric heater further comprises, a first conductor formed from a first conductor material, the first conductor electrically connected to the resistor, and a second conductor formed from a second conductor material, the second conductor electrically connected to the resistor.

In another advantageous embodiment, an electric heater is provided comprising, a resistor formed of at least one noble metal and an oxide selected from the group consisting of yttrium oxide, cerium oxide, zirconium oxide, and combinations of these. The electric heater further comprises, a first conductor formed from a first conductor material, the first conductor electrically connected to the resistor, and a second conductor formed from a second conductor material, the second conductor electrically connected to the resistor. The electric heater still further comprises, an electrical power source, electrically connected to the resistor via the first and second conductors. The electric heater is provided such that the resistor provides heating to an area proximate to the resistor based on an applied electrical power from the electrical power source.

In still another advantageous embodiment, a method for manufacturing a heater is provided comprising the steps of, forming a resistor of a material having at least one noble metal and an oxide selected from the group consisting of yttrium oxide, cerium oxide, zirconium oxide, and combinations of these. The method further comprises, electrically connecting a first conductor to the resistor, the first conductor formed from a first conductor material, and electrically connecting a second conductor to the resistor, the second conductor formed from a second conductor material. The method still further comprises, providing heating of an area adjacent to the resistor when electrical power is applied to the resistor via the first and second conductors.

The invention and its particular features and advantages will become more apparent from the following detailed description considered with reference to the accompanying drawings.

DETAILED DESCRIPTION OF THE DRAWINGS

Figure 1:
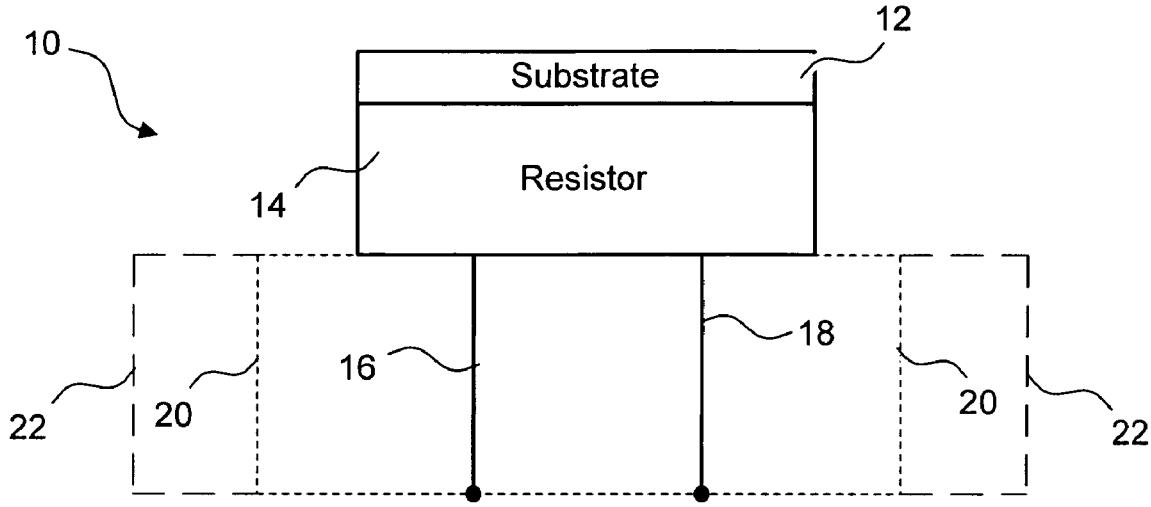
FIG. 1 is a block diagram of one advantageous embodiment of the present invention.

Referring now to the drawings, wherein like reference numerals designate corresponding structure throughout the views.

FIG. 1 is a block diagram illustrating one preferred embodiment of the present invention showing heater 10. A substrate 12 is shown in contact with a resistor 14. Also shown are first conductor 16 and second conductor 18, both of which are shown connected to resistor 14.

Resistor 14 may comprise, for instance, a noble metal such as a platinum group metal, and a metal oxide selected from the group consisting of: yttrium oxide, cerium oxide, zirconium oxide, and combinations of these. It is further contemplated that through a process called dispersion hardening, the metal oxides may be deposited within the grain boundaries and main body of the noble metal. This process produces a resistor 14 formed of a highly stable material capable of withstanding mechanical loads and chemical attacks at elevated temperatures while maintaining its internal chemical integrity. This is highly desirable especially in hostile environments where the resistor is subjected to mechanical stress and/or a wide range of temperatures.

In one preferred embodiment resistor 14 comprises platinum, having yttrium oxide or yttrium and zirconium oxide dispersed within its grain boundary and within the main body portion. In another preferred embodiment resistor 14 comprises a platinum rhodium alloy (10% rhodium) having yttrium oxide or yttrium and zirconium oxide dispersed within its grain boundary and within the main body.

The output temperature $T_{out}$ is dependent upon the applied electrical power. For example, a variation in either voltage or current will result in a change in the output temperature $T_{out}$. It should be noted that DPH materials have a relatively low alpha or temperature coefficient. This means that, while some heaters may tend to exhibit self-regulating tendencies, heater 10, comprising the DPH material will have relatively low self-regulation. Therefore, as the temperature increases, power consumption is not greatly inhibited resulting in a heater with high heat output over the entire operating temperature. The DPH structure can withstand the high operating temperatures, thus allowing for stable operation under steady state or cycling conditions.

It should further be noted that, the conductors 16, 18 may further be provided as dispersion hardened material, providing for a higher operating temperature than conventional wires or conductors. For conductors, it is desirable that lead resistance to be negligible and not affected by heat. Thus low resistivity and alpha is desired. While the use of larger diameter wires will reduce resistivity, this has the disadvantage of increasing costs.

Conversely, heater 10 may effectively be operated in a limited current mode to regulate the output temperature $T_{out}$ electronically.

Heater 10 is further illustrated in FIG. 1 with insulation 20 (shown as a hidden line), which may be used to insulate, for example, first and second conductors 16, 18. The insulation may comprise any suitable insulating material desired including but not limited to a refractory ceramic material such as for instance, $Al_2O_3$ or MgO.

Also illustrated in FIG. 1 is sheath 22 (shown as a dashed line), enclosing insulation 20. It is contemplated that in one advantageous embodiment that the sheath 22 (when used) may comprise the same material described above in connection with resistor 14.

Figure 2:
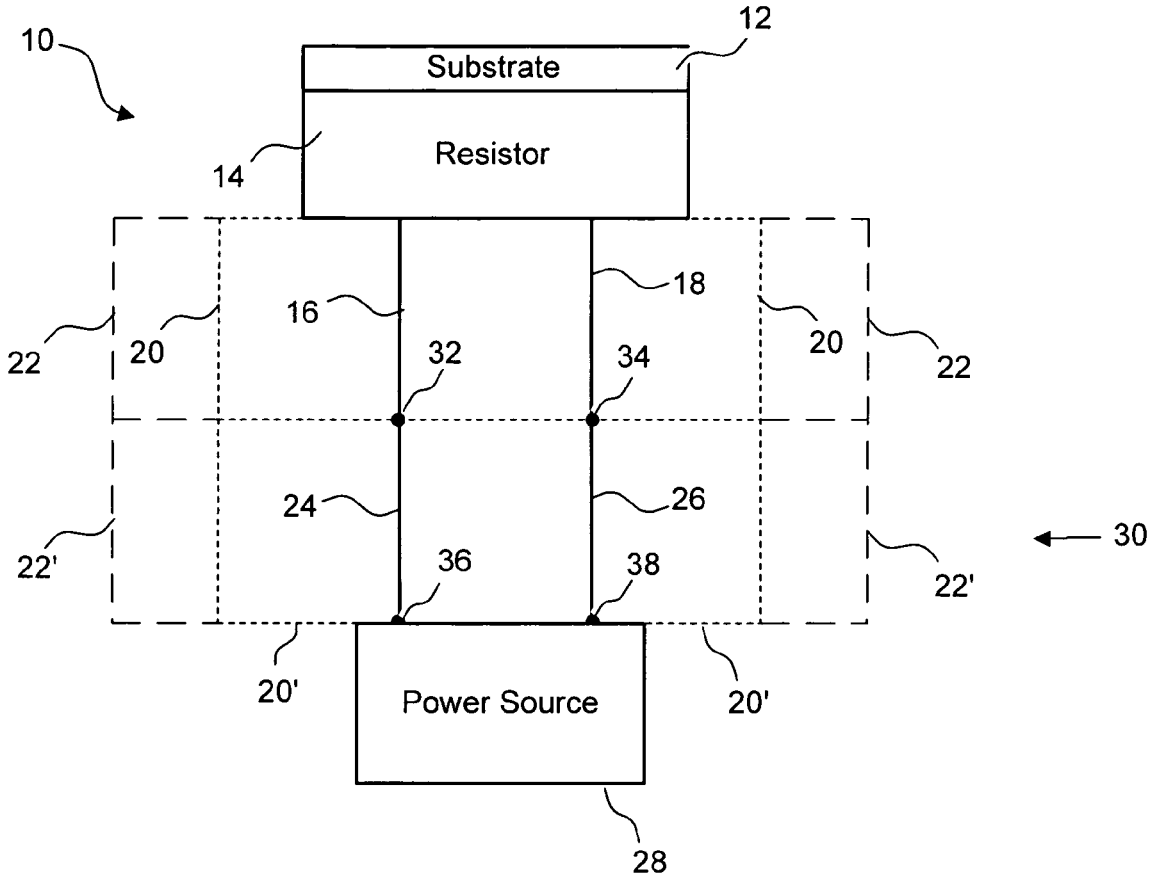
FIG. 2 is block diagram showing advantageous configuration of the embodiment shown in to FIG. 1.
Figure 3:
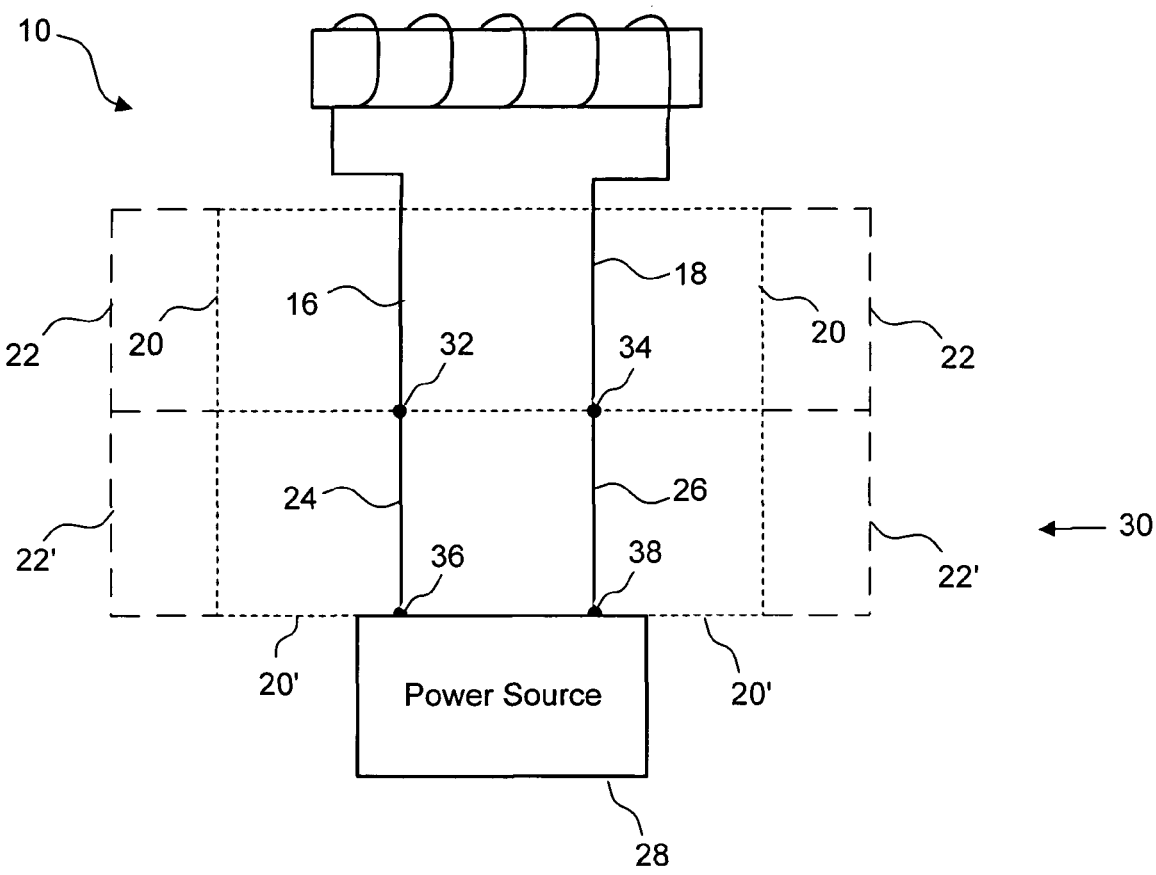
FIG. 3 is block diagram showing another advantageous configuration of the embodiment shown in to FIG. 1.

Referring now to FIGS. 2 and 3, a heater 10 is made with a resistor 14 of a class of materials chosen to be resistant to degradation in high temperature operation up to 1700° C. (3090° F.) and deposited on and/or around a substrate 12. The class of materials is made up of one or more base metals, usually a noble metal, with metal oxides. In one advantageous embodiment the metal oxides may comprise yttrium oxide, cerium oxide, zirconium oxide, and combinations of these. In addition, the metal oxides may be deposited within the grain boundaries and main body of the base metal. The process is called dispersion hardening. This has the effect of stabilizing the grain structure of the material at extended temperatures and provides an increased resistance path for impurities. The net effect is a highly stable material capable of withstanding mechanical loads and chemical attacks at elevated temperatures while maintaining its internal chemical integrity. This provides the foundation for an extended temperature variable resistance heater with long term, stable output and minimum drift in resistance.

The base metal may be chosen from the noble metals such as for instance, the platinum group metals. It is preferable that the resistor 14 be made of platinum or Pt/Rh, having yttrium oxide or yttrium and zirconium oxide dispersed within its grain boundary. However, it is foreseeable that the resistor could be formed from an oxide from the group consisting of the transition metals or the rare earth metals, or a combination thereof, dispersion hardened within the grain boundary of a base and main body metal consisting of the noble metals or the precious metals, or combinations thereof.

The resistor 14, with any cross sectional geometry, may be deposited on a substrate. (FIG. 2). Similarly the resistor material may be wound around a nonconductive, high temperature substrate to a predetermined resistance value. (FIG. 3).

Substrate 12, in these embodiments, may for example, be formed as resistor 14, having at least one noble metal with a metal oxide from the group consisting of yttrium oxide, cerium oxide, zirconium oxide, and combinations of these, dispersed within its grain boundary. Refractory materials or one of the base materials coated with a high temperature insulator of varying compositions such $Al_2O_3$ or MgO may also be used as the substrate. It should be noted that when substrate 12 is formed of the same material as resistor 14, an insulating coating should be applied to the DPH substrate 12. It should also be noted that the heater may be formed from the same material deposited on the insulator and etched to produce the desired resistance.

In operation, a current is applied to resistor 14 by power source 28, which in turn will produce heat in proportion to the applied current. In this manner, precise heating may be achieved in many diverse applications, including for example, but not limited to, aerospace, petroleum, glass industries, and laboratory testing applications.

Also illustrated in FIGS. 2 and 3 is an optional transmit lead module 30 that includes transmit leads 24, 26. Transmit lead module insulation 20' is shown enclosing transmit leads 24, 26. Transmit lead module insulation 20' may comprise any material as previously described in connection with insulation 20. Further illustrated is transmit lead module sheath 22', which encloses transmit lead module insulation 20'. Transmit lead module sheath 22' may also comprise any material as previously described in connection with sheath 22. It is further contemplated that, although only one transmit lead module 30 is shown in FIGS. 2 and 3, any number may be connected together, for instance in an end-to-end fashion, as required depending upon the installation.

First and second conductors 16, 18 for conducting electrical power, may be electrically connected between resistor 14 and power source 28. In one embodiment, transmit leads 24, 26 may comprise a different material composition(s) than the first and second conductors 16, 18 creating a junction at 32, 34. Another possible junction point 36, 38 may comprise still another differing material composition than the transmit leads 24, 26. It should also be noted that the electrical power applied to resistor 14 may be electrically compensated for these junction points of differing compositions where extremely precise heating is critical, for example, in a laboratory experiment.

Figure 4:
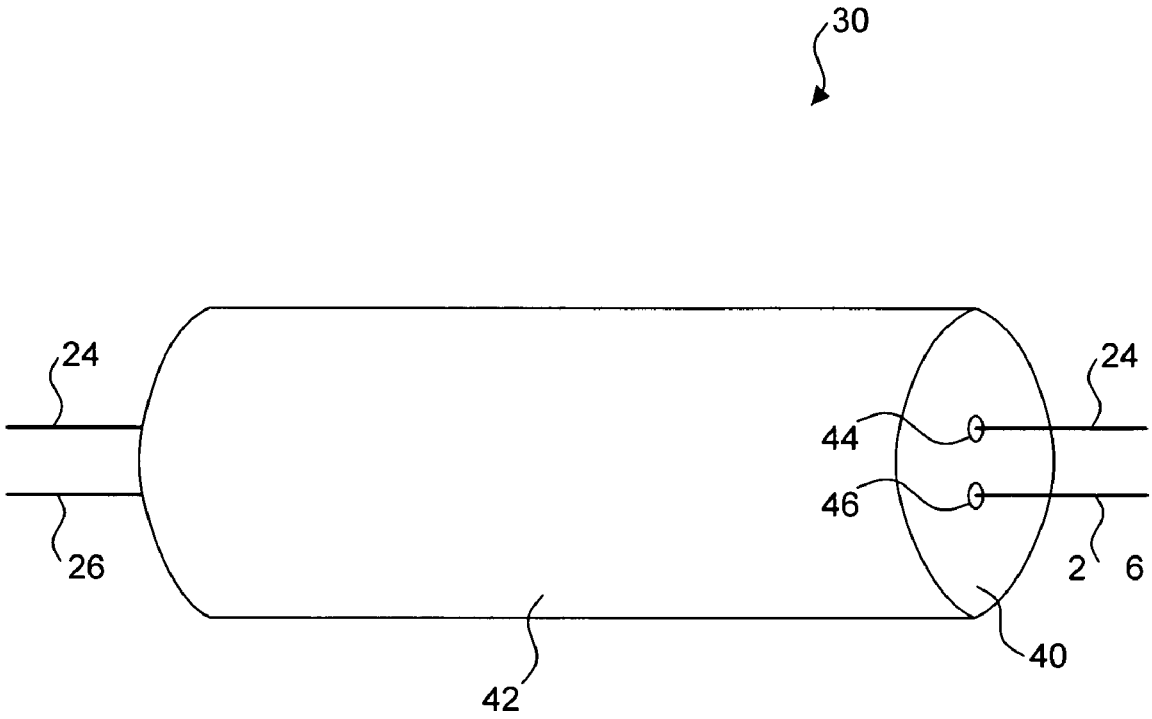
FIG. 4 is a illustration of the transmit lead module as shown in FIGS. 3 and 4.

The structure and method for manufacturing transmit lead module 30 in one advantageous embodiment as illustrated in FIG. 4, will now be described. Transmit lead module 30 generally comprises: transmit leads 24, 26; insulating layer 40; and outer layer 42. Transmit leads 24, 26 may comprise any suitable materials as previously described herein in connection with FIGS. 1-3. Insulating layer 40 may comprise, for instance, a refractory ceramic material such as $Al_2O_3$ or MgO generally formed into an elongated member, such as for instance, but not limited to, a cylinder. Also illustrated in FIG. 4 are two through holes 44, 46 extending axially through the length of insulating layer 40 through which transmit leads 24, 26 are respectively inserted. Surrounding and encasing insulating layer 40 is outer layer 42. Outer layer 42 may comprise in one advantageous embodiment, the same material as one of transmit leads 24, 26. One advantage realized from this particular configuration is that one of the electrical lead/transmit lead junctions may be eliminated. As previously stated, dispersion hardened material provides for a higher operating temperature than conventional wires or conductors. For conductors, it is desirable that lead resistance to be negligible and not affected by heat. Thus low resistivity and alpha is desired.

Once the insulating layer 40 containing transmit leads 24, 26 is inserted into outer layer 42, the entire transmit lead module 30 may be swaged. The compression of transmit lead module 30 causes insulating layer 40 to be compressed and tightly crushed such that air is evacuated and any air pockets within transmit lead module 30 may be effectively eliminated.

Any number of transmit lead modules 30 may then be tied together depending upon the distance between heater 10 and power source 28. This provides versatility and modularity to the system as the installer may utilize any number of transmit lead modules 30 in an installation. Transmit lead modules 30 may further be bent and manipulated as desired to custom fit a particular installation. The outer layer 42 being rigid further provides protection for transmit leads 24, 26 from wear, abrasion and repeated bending and/or flexing. This will increase the effective lifespan of the system. In addition, as previously discussed, transmit lead modules 30 may be joined together with each other in an end-to-end fashion with transmit leads 24, 26 in the first transmit lead module 30 forming a junction with transmit leads 24, 26 in the second transmit lead module 30. However, when the exterior layer 42 for both the first and second transmit lead modules 30 comprises the same material as one of the transmit leads 24, 26, then the corresponding transmit lead junction may be eliminated further simplifying the system.

It should further be noted that, even though only two conductors 16, 18 have been illustrated as connected to resistor 14, it is contemplated that virtually any number of conductors may effectively be connected to resistor 14 for providing, for example, a variable heating output. It is further contemplated that variable heating may further be accomplished by varying the voltage and/or current supplied to resistor 14 by power source 28. In this manner, precise heating may be accomplished for critical applications.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An electric heater comprising:

a resistor deposited on a substrate, said resistor giving off heat in proportion to applied electrical power;

said resistor formed of at least one noble metal and an oxide selected from the group consisting of yttrium oxide, cerium oxide, zirconium oxide, and combinations of these;

a first conductor formed from a first conductor material, said first conductor electrically connected to said resistor; and a second conductor formed from a second conductor material, said second conductor electrically connected to said resistor;

a sheath enclosing said conductors, said sheath is formed of at least one noble metal and an oxide selected from the group consisting of yttrium oxide, cerium oxide, zirconium oxide, and combinations of these;

said sheath being electrically insulated from said first and said second conductors.

2. The electric heater of claim 1 wherein the sheath material further comprises yttrium oxide and zirconium oxide.

3. The electric heater of claim 1 wherein the first conductor material and the second conductor material are the same.

4. The electric heater of claim 3 wherein the first conductor material and the second conductor material are different than the sheath material.

5. The electric heater of claim 1 wherein the noble metal is a platinum group metal.

6. The electric heater of claim 5 wherein the noble metal is platinum.

7. The electric heater of claim 6 wherein the oxide is dispersion hardened within grain boundaries and a main body portion of the platinum.

8. The electric heater of claim 5 wherein the noble metal is platinum rhodium alloy.

9. The electric heater of claim 8 wherein the oxide is dispersion hardened within grain boundaries and a main body portion of the platinum rhodium alloy.

10. The electric heater of claim 9 wherein the platinum rhodium alloy is Pt-10% Rh.

11. An electric heater comprising:

a resistor formed of at least one noble metal and an oxide selected from the group consisting of yttrium oxide, cerium oxide, zirconium oxide, and combinations of these;

a first conductor formed from a first conductor material, said first conductor electrically connected to said resistor; and a second conductor formed from a second conductor material, said second conductor electrically connected to said resistor; and an electrical power source, electrically connected to said resistor via said first and second conductors;

said resistor providing heating to an area proximate to said resistor based on an applied electrical power from said electrical power source;

a sheath enclosing said conductors, said sheath is formed of at least one noble metal and an oxide selected from the group consisting of yttrium oxide, cerium oxide, zirconium oxide, and combinations of these;

said sheath being electrically insulated from said first and said second conductors.

12. The electric heater according to claim 11 wherein said resistor is deposited on a substrate.

13. The electric heater according to claim 11 wherein said resistor is wound around an insulator.

14. A method for manufacturing a heater comprising the steps of:

forming a resistor of a material having at least one noble metal and an oxide selected from the group consisting of yttrium oxide, cerium oxide, zirconium oxide, and combinations of these;

electrically connecting a first conductor to the resistor, the first conductor formed from a first conductor material;

electrically connecting a second conductor to the resistor, the second conductor formed from a second conductor material;

providing heating of an area adjacent to the resistor when electrical power is applied to the resistor via the first and second conductors; and enclosing the conductors in a sheath that is formed of at least one noble metal and an oxide selected from the group consisting of yttrium oxide, cerium oxide, zirconium oxide, and combinations of these where the sheath is electrically insulated from the first and the second conductors.

15. The method according to claim 14 further comprising the step of positioning the resistor on a substrate.

16. The method according to claim 14 wherein the sheath material further comprises yttrium oxide and zirconium oxide.

17. The method according to claim 14 wherein the noble metal is a platinum group metal.

18. The method according to claim 17 wherein the noble metal is platinum.

19. The method according to claim 18 further comprising the step of dispersion hardening the oxide within grain boundaries and a main body portion of the platinum.

20. The method according to claim 17 wherein the noble metal is platinum rhodium alloy.

21. The method according to claim 20 further comprising the step of dispersion hardening the oxide within grain boundaries and a main body portion of the platinum rhodium alloy.

22. The method according to claim 21 wherein the platinum rhodium alloy is Pt-10% Rh.

* * * * *